US006718944B2

(12) United States Patent
Franke et al.

(10) Patent No.: US 6,718,944 B2
(45) Date of Patent: Apr. 13, 2004

(54) METHOD OF CYLINDER SHUT-OFF IN AN INTERNAL COMBUSTION ENGINE, IN PARTICULAR OF A VEHICLE, AND APPROPRIATE DEVICE

(75) Inventors: Steffen Franke, Brentwood (GB); Axel Heinstein, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/181,849

(22) PCT Filed: Jan. 10, 2001

(86) PCT No.: PCT/DE01/00060

§ 371 (c)(1),
(2), (4) Date: Nov. 8, 2002

(87) PCT Pub. No.: WO01/53680

PCT Pub. Date: Jul. 26, 2001

(65) Prior Publication Data

US 2003/0116129 A1 Jun. 26, 2003

(30) Foreign Application Priority Data

Jan. 20, 2000 (DE) ..... 100 02 268

(51) Int. Cl.[7] ..... F02P 5/00
(52) U.S. Cl. ..... 123/406.29; 123/406.47
(58) Field of Search ..... 123/406.29, 406.47, 123/481

(56) References Cited

U.S. PATENT DOCUMENTS

| | | | | |
|---|---|---|---|---|
| 5,005,549 A | * | 4/1991 | Pernpeintner et al. | 123/406.27 |
| 5,190,013 A | * | 3/1993 | Dozier | 123/481 |
| 6,278,932 B1 | * | 8/2001 | Baumel et al. | 701/104 |
| 6,336,440 B1 | * | 1/2002 | Schmitz et al. | 123/406.27 |
| 6,487,998 B1 | * | 12/2002 | Masberg et al. | 123/192.1 |
| 6,520,159 B2 | * | 2/2003 | White et al. | 123/481 |

FOREIGN PATENT DOCUMENTS

| | | |
|---|---|---|
| DE | 31 08 374 | 3/1982 |
| DE | 197 19 631 | 9/1998 |
| DE | 198 28 710 | 1/1999 |

* cited by examiner

*Primary Examiner*—John Kwon
(74) *Attorney, Agent, or Firm*—Kenyon & Kenyon

(57) ABSTRACT

The method and the device are used for cylinder shut-off in an internal combustion engine (10), in particular of a vehicle, using a control unit (15) in effective operational contact with the cylinders (11, 12, 13, 14) of the internal combustion engine (10), which has a monitoring unit (21), a knock regulating unit (20) and a fuel injector shut-off unit (22). At the same time the provision is made that the fuel injector shut-off unit (22) is operationally linked to the knock regulating unit (20) to achieve coordinated cylinder shut-off. The fuel injector shut-off unit (22) is provided with a memory medium (23) for storing a cylinder shut-off program.

11 Claims, 1 Drawing Sheet

METHOD OF CYLINDER SHUT-OFF IN AN INTERNAL COMBUSTION ENGINE, IN PARTICULAR OF A VEHICLE, AND APPROPRIATE DEVICE

FIELD OF THE INVENTION

The present invention relates to a method of cylinder shut-off in an internal combustion engine, in particular of a vehicle, corresponding to a shut-off program.

Furthermore, the present invention relates to a device for cylinder shut-off in an internal combustion engine, in particular of a motor vehicle, using a control unit which is in effective operational contact with the cylinders of the internal combustion engine, which has a monitoring unit, a knock regulating unit and a fuel injector shut-off unit.

BACKGROUND INFORMATION

Conventionally, cylinder shut-off in an internal combustion engine, in particular of a vehicle, corresponds to a predefined shut-off program. Here, a shut-off of the corresponding fuel injectors for selected cylinders takes place, so that fuel is no longer supplied to the corresponding cylinder, i.e., combustion chamber. Thus, no combustion occurs in the cylinders shut off in this way. A fuel injector shut-off, i.e., a cylinder shut-off, may be provided here for the following reasons:

- to implement a reduction in torque, which is necessary during interventions of an acceleration-spin control (ASR) or an antilock-braking system (ABS), or to create a fuel-optimizing reserve of torque for rapid torque build-up;
- for torque-neutral reduction of throttle losses under partial load in order to achieve greater overall efficiency;
- to protect the catalytic converter when combustion is interrupted.

In all of the cases identified above, the cylinders are shut off by using a masking pattern which is fixedly preset in the first two cases and allows free shut-off of one or more cylinders, while in the third case the masking pattern is preset by a misfire recognition system. Disadvantageously, with cylinder shut-off using a masking pattern in one or more of the cases named above, degradation of engine efficiency results.

SUMMARY

In accordance with an example embodiment of the present invention, in a method of cylinder shut-off in an internal combustion engine, in particular of a vehicle, a shut-off program shuts the cylinders off by coordinating the shut-off program with knock regulation of the individual cylinders of the internal combustion engine. Using a conventional system of knock regulation of individual cylinders, each cylinder of the internal combustion engine is operated at optimum efficiency, i.e., at the knock limit, under consideration of various operating conditions. Because variation occurs between individual cylinders in regard to compression, charge, thermal load, air ratio value (lambda) and other operating parameters, the margin between the real knock limit and the theoretical optimal efficiency, and thus also the ignition angle efficiency, varies by individual cylinder. Furthermore, knock regulation of individual cylinders allows activation of a knock regulation/guide cylinder function, whereby cylinders having poor or no knock recognition are guided by the other cylinders of the internal combustion engine which have good knock recognition. The leading cylinders are also referred to as guide cylinders. Thus, the knock regulation of individual cylinders provides data or information which may be important for achieving efficiency-optimized cylinder shut-off. By coordinating cylinder shut-off and knock regulation by individual cylinders, it is possible to ensure in a reliable way that, in case of need, those cylinders will be shut off which are working at relatively low efficiency and/or are being operated as guided cylinders. Cylinder shut-off which significantly reduces engine efficiency, in the form of shutting off the cylinders working at high efficiency and/or the guide cylinders, is, thus, possibly prevented under consideration of data from the system of knock regulation by individual cylinders which is relevant to shut-off.

According to one example embodiment, a cylinder-specific ignition angle retardation value is used as a cylinder shut-off criterion. By using the cylinder-specific ignition angle retardation value, it is possible to determine the ignition angle efficiency of the respective cylinder. It is thus possible, by appropriate selection of the cylinder to be shut off, i.e., the cylinder with the greatest ignition angle retardation at the moment and thus having the relatively lowest ignition angle efficiency, to achieve efficiency-optimized cylinder shut-off.

According to another example embodiment, a classification of the cylinders in terms of a knock regulation-guide cylinder function is used as a cylinder shut-off criterion. When a knock regulation-guide cylinder function is activated the guided cylinders always exhibit ignition angle retardation quantitatively greater than or equal to the guide cylinders. It is thus, possible, through classification, to reliably prevent shut-off of a guide cylinder before a guided cylinder which has not yet been shut off.

The cylinders may be shut off corresponding to a hierarchy according to the classification of the cylinders. Through creation of a hierarchy corresponding to predetermined ranking criteria, it is possible to ensure automatic, efficiency-optimized cylinder shut-off in a particularly effective manner, using, for example, a control unit. The hierarchy may be organized here, for example, as a bit matrix, which advantageously allows rapid access to data stored in it and thus makes particularly effective automatic cylinder shut-off possible.

Advantageously, the cylinders may be assigned according to the hierarchy, with decreasing cylinder shut-off priority, to the priority groups: guided cylinders, neutral cylinders and guide cylinders. This allows efficiency-optimized cylinder shut-off, under which, when necessary, the cylinders defined by the knock regulation system as guided cylinders are shut off first, and only after all of the guided cylinders are shut off are the neutral cylinders (neither guided nor guide cylinders) released for shut-off. Only under the condition that all of the guided and neutral cylinders have already been shut off is shut-off of a guide cylinder allowed in the event of need. In this way, avoidable degradations of engine efficiency due to unfavorable cylinder shut-off are prevented, so that the internal combustion engine is operated at the best ignition angle efficiency possible under the existing conditions. This results in a corresponding reduction in fuel consumption and a lowering of exhaust gas emissions during operation of the internal combustion engine.

According to another example embodiment of the present invention, the specific fuel consumption of the respective cylinder is used as a shut-off criterion. The specific fuel consumption for a cylinder may be calculated in a precise manner from the respective injection time and the respective cylinder moment, which in turn may be determinable from the measured segment time. Thus, the specific fuel consumption is also suitable as a cylinder shut-off criterion, as an alternative to the ignition angle.

Advantageously, the cylinder shut-off may take place in the form of a shut-off of fuel injectors belonging to a cylinder which is to be shut off. This enables particularly rapid, reliable and precisely controllable cylinder shut-off.

The device according to the example embodiment of the present invention is characterized by the fact that the fuel injector shut-off unit is operationally linked to the knock regulating unit to achieve coordinated cylinder shut-off. By using a device of this design, it is possible to execute a method of cylinder shut-off in an internal combustion engine while achieving the forenamed advantages.

According to an example embodiment, the fuel injector shut-off unit is provided with a memory medium for storing a cylinder shut-off program. This permits central storage of a control program created according to one or possibly more cylinder shut-off criteria for efficiency-optimized cylinder shut-off.

DETAILED DESCRIPTION

Figure 1:
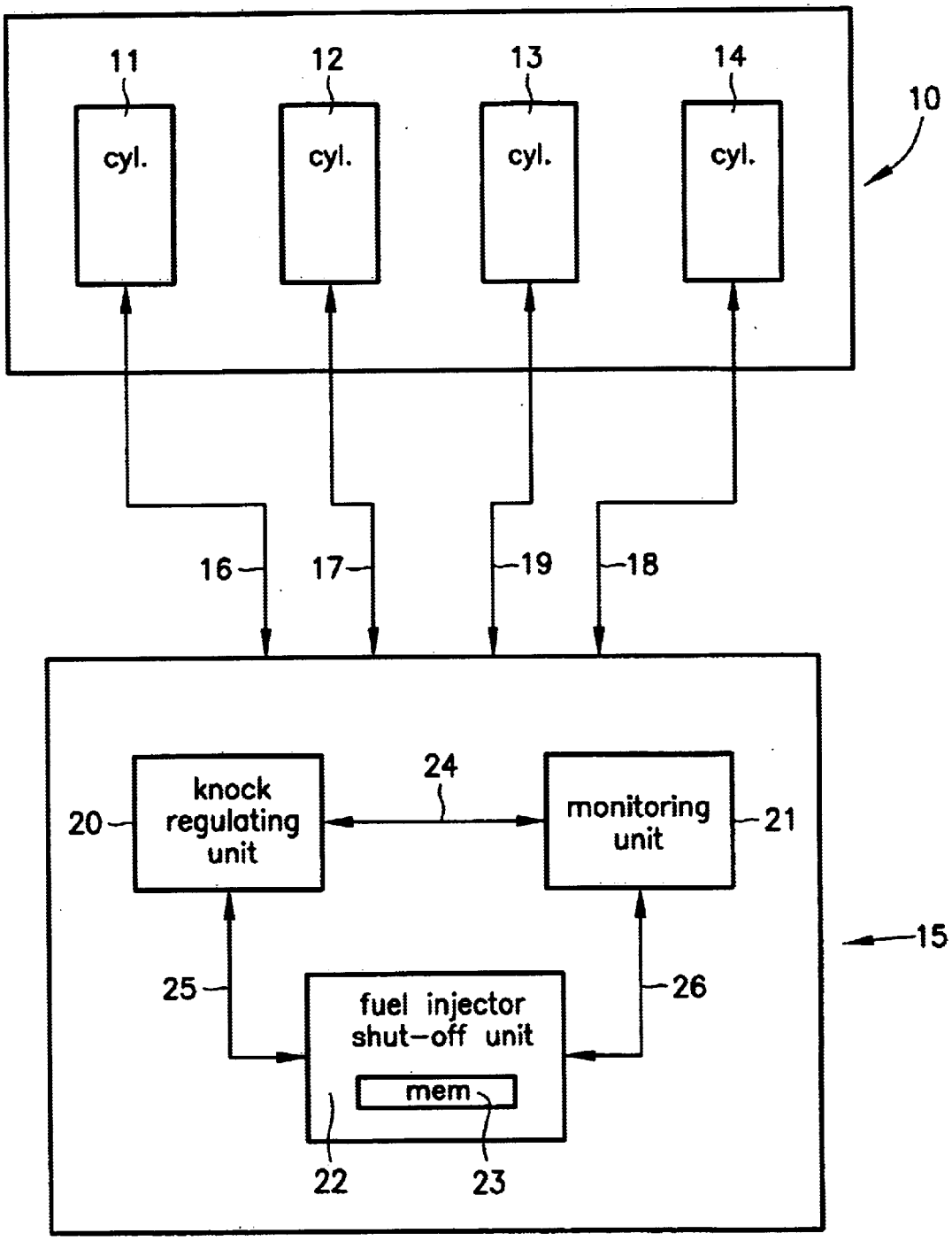
FIG. 1 shows a schematic representation of an internal combustion engine operationally linked to a control unit in accordance with an example embodiment of the present invention.

FIG. 1 shows a schematic representation of an internal combustion engine 10 which in this case has four cylinders 11, 12, 13, 14. A control unit generally designated as 15 is operationally linked to each of cylinders 11, 12, 13, 14 using control lines which are represented schematically as double arrows 16, 17, 18, 19. Control unit 15 has a knock regulating unit 20, a monitoring unit 21 and a fuel injector shut-off unit 22, which are operationally linked to each other using data transmission lines, which are represented schematically as double arrows 24, 25, 26. Fuel injector shut-off unit 22 is provided with a memory medium 23.

Control unit 15 is suitable for initiating a cylinder shut-off in coordination with cylinder-specific knock regulation of internal combustion engine 10. For this purpose, operation-specific parameter values for individual cylinders, in particular of internal combustion engine 10, are determined by the monitoring unit 21, and are conveyed to knock regulating unit 20 and/or fuel injector shut-off unit 22 via the associated data transmission lines (double arrows 24, 26). Furthermore knock regulating unit 20, using the data transmission line represented as double arrow 25, conveys operating data which is relevant for cylinder shut-off. The cylinder shut-off-relevant data transmitted by knock regulating unit 20 and monitoring unit 21 to fuel injector shut-off unit 22 is further processed by the latter in such a way that a cylinder-specific shut-off sequence may be created, which is stored in memory medium 23 and according to which the shut-off program initiates a cylinder shut-off in coordination with knock regulation of the individual cylinders of internal combustion engine 10 in the event of need. The cylinder-specific shut-off sequence is thus part of the shut-off program. An ignition angle retardation value of the knock regulating system for the individual cylinder, a knock regulation-guide cylinder function and/or the specific fuel consumption of the individual cylinder may be used as the cylinder shut-off criterion for creating the cylinder-specific shut-off sequence.

The cylinder shut-off sequence may be realized for example in the form of a bit matrix having the following structure:

| | |
|---|---|
| Cylinder no.: (cylinder shut-off) | 4321 |
| Cylinder shut-off [1] = cylinder 2 is shut off first, if necessary; | 0010 |
| Cylinder shut-off [2] = cylinders 2 and 3 are shut off, if necessary; | 0110 |
| Cylinder shut-off [3] = cylinders 1, 2 and 3 are shut off, if necessary; | 0111 |
| Cylinder shut-off [4] = cylinders 1, 2, 3 and 4 are shut off, if necessary. | 1111 |

According to this exemplary shut-off sequence, a cylinder shut-off, if necessary, takes place in sequence cylinder 2, cylinder 3, cylinder 1 and finally cylinder 4. Here, according to this shut-off sequence cylinder 2 exhibits the poorest efficiency (large ignition angle retardation value, high specific fuel consumption, guided cylinder), and cylinder 4 has the best efficiency (small ignition angle retardation value, low specific fuel consumption, guide cylinder). The cylinder shut-off takes place in the form of a shut-off of associated fuel injectors (not shown) of the particular cylinder of internal combustion engine 10 which is to be shut off.

Since the cylinder shut-off sequence stored in memory medium 23 is continuously adapted depending on the currently prevailing operating parameter values, it is possible to obtain efficiency-optimized cylinder shut-off based on the coordination with the knock regulation in the individual cylinders of internal combustion engine 10.

What is claimed is:

1. A method of cylinder shut off in an internal combustion engine of a vehicle, the internal combustion engine having a plurality of cylinders, the method comprising:

determining a number of cylinders to be shut-off based on a desired torque of the internal combustion engine;

establishing a shut-off sequence of the cylinders based on the number of cylinders to be shut off and using data from a cylinder-selective knock regulation of the internal combustion engine; and shutting off the cylinders based on the shut-off sequence.

2. The method according to claim 1, wherein a cylinder-specific ignition angle retardation value is used as a cylinder shut-off criterion.

3. The method according to claim 1, wherein a classification of the cylinders in terms of a knock regulation-guide cylinder function is used as a cylinder shut-off criterion.

4. The method according to claim 3 wherein the cylinders are shut off corresponding to a hierarchy according to the classification of the cylinders.

5. The method according to claim 4, further comprising:

assigning the cylinders according to the hierarchy, with decreasing cylinder shut-off priority to priority groups of: guided cylinders, neutral cylinders and guide cylinders.

6. The method according to claim 1, wherein specific fuel consumption of the cylinders is used as a cylinder shut-off criterion.

7. The method according to claim 1, wherein the shutting off includes shutting off a fuel injector belonging to a cylinder which is to be shut off.

8. The method according to claim 1, wherein the internal combustion engine is an internal combustion engine of a vehicle.

9. A device for cylinder shut-off in an internal combustion engine having a plurality of cylinders, the device comprising:

a control unit configured to determine a number of cylinders to be shut-off based on a desired torque of the internal combustion engine, the control unit further configured to establish a shut-off sequence of the cylinders based on the number of cylinders to be shut off and using data from a cylinder-selective knock regulation of the internal combustion engine, and the control unit further configured to shut off the cylinders based on the shut-off sequence.

10. The device according to claim 9, further comprising:

a memory medium coupled to the control unit and configured to store a cylinder shut-off program.

11. The device according to claim 9, wherein the internal combustion engine in an internal combustion engine of a vehicle.

* * * * *

UNITED STATES PATENT AND TRADEMARK OFFICE

CERTIFICATE OF CORRECTION

PATENT NO. : 6,718,944 B2
DATED : April 13, 2004
INVENTOR(S) : Steffen Franke et al.

It is certified that error appears in the above-identified patent and that said Letters Patent is hereby corrected as shown below:

Title page,
Item [57], ABSTRACT,
Line 1, change "The" to -- A --; and
Line 1, delete "are used"; and
Line 2, delete "(10)"; and
Line 3, delete "(15)"; and
Line 3, change ", using a" to -- is described. A --; and
Line 3, change "in effective" to -- is used in effective --; and
Line 4, delete "(11, 12, 13, 14)"; and
Line 5, delete "(10)" and "(21)"; and
Line 5, change "engine, which" to -- engine. --; and
Line 5, change "has a monitoring" to -- The control unit has a monitoring --; and
Lines 6 and 9, delete "(20)"; and
Line 7, change "At the same time the provision is made that the" to -- The --; and
Lines 7, 8 and 10, delete "(22)"; and
Line 11, delete "(23)".

Signed and Sealed this

Fifth Day of April, 2005

JON W. DUDAS
*Director of the United States Patent and Trademark Office*